United States Patent [19]

LeBegue

[11] 4,253,705

[45] Mar. 3, 1981

[54] CONTINUOUS MINING MACHINE HAVING A BOOM MEMBER WITH A FIXED MATERIAL DISLODGING MEANS

[75] Inventor: Maurice K. LeBegue, Argillite, Ky.

[73] Assignee: National Mine Service Company, Pittsburgh, Pa.

[21] Appl. No.: 47,683

[22] Filed: Jun. 12, 1979

[51] Int. Cl.[3] ..... E21C 27/24

[52] U.S. Cl. ..... 299/76; 299/89

[58] Field of Search ..... 299/75, 76, 89

[56] References Cited

U.S. PATENT DOCUMENTS

| | | | |
|---|---|---|---|
| 2,808,253 | 10/1957 | Miller | 299/89 X |
| 3,773,384 | 11/1973 | Anderson | 299/76 |
| 3,774,969 | 11/1973 | LeBegue | 299/76 |
| 3,966,257 | 6/1976 | Shah | 299/89 X |
| 4,076,316 | 2/1978 | LeBegue | 299/75 X |

*Primary Examiner*—Ernest R. Purser

*Attorney, Agent, or Firm*—Stanley J. Price, Jr.; John M. Adams

[57] ABSTRACT

A continuous mining machine has a mobile body portion with a boom member pivotally secured thereto and extending forwardly therefrom. A cylindrical drum member is rotatably mounted on front of the boom member and includes a cylindrical intermediate section and a pair of end sections extending outwardly from the intermediate section. Cutting elements for dislodging material from a mine face extend from the respective drum sections. The cutting elements of the end sections are spaced from the adjacent cutting elements of the intermediate section by a pair of openings separating the intermediate section from the end sections respectively. A pair of nonrotatable housing assemblies extending forwardly from the boom member extend around the pair of openings. Each housing assembly has a tubular portion through which input shafts extend to transmit rotation to each of the end sections and therefrom by shafts extending from the end sections to the intermediate section to rotate the intermediate section. Each housing assembly has a body portion extending around the respective opening between the drum member sections and includes an outwardly projecting portion provided with tapered sidewalls that terminate in an edge portion. The housing tapered edge portions are operable to dislodge material from the mine face in front of the pair of openings between the end sections and the intermediate section so that a kerf is cut from the mine face extending along the entire length of the drum member.

11 Claims, 3 Drawing Figures

CONTINUOUS MINING MACHINE HAVING A BOOM MEMBER WITH A FIXED MATERIAL DISLODGING MEANS

BACKGROUND OF THE INVENTION

1. Field of the Invention

This invention relates to a continuous mining machine and more particularly to a mining machine having a cutter drum member rotatably supported by a boom member that includes a pair of housings that enclose the openings between sections of the drum member and are operable to dislodge the material not dislodged by the drum member sections so that a single kerf is dislodged from the mine face along the entire length of the drum member.

2. Description of the Prior Art

Continuous mining machines with transverse cutting elements positioned in front of the mining machine are known as illustrated in U.S. Pat. Nos. 2,695,164 and 3,310,347. These machines include a pair of boom members extending forwardly from the mining machine frame with disc-like rotatable dislodging elements mounted thereon. The dislodging elements are arranged to rotate and move transversely while dislodging material from the mine face.

U.S. Pat. Nos. 2,721,733; 3,109,636 and 3,305,273 disclose mining machines having a full face drum that is arranged to dislodge material from the mine face without transverse oscillating movement. As illustrated in U.S. Pat. No. 3,305,273, the support means and drive means for the drum include fixed portions of the drum member extending around the drum. Endless chain elements are required to extend over the fixed housing to dislodge the material from the mine face within the width of the fixed housing.

U.S. Pat. No. 3,109,636 utilizes a boom member having arm portions that extend forwardly and have bearing supports that rotatably support the drum member. Drive shafts extend along the drum member arm portions into the inner portion of the drum to rotate the drum. The bearing supports on the front end of the boom member cannot rotate with the drum member and do not dislodge material from the face along the width of the bearing supports.

In U.S. Pat. No. 2,721,733 sprocket members are provided along the end of the drum. Endless drive chains are connected to the sprockets and rotate the drum. Cutter bits extend outwardly from the chains to dislodge the material along the width of the chains.

U.S. Pat. No. 3,774,969 discloses a drum member having a pair of axially aligned intermediate sections and a pair of end sections arranged in non-parallel relation with the intermediate sections and extending forwardly relative thereto. Along the front portion of the drum member, the end section inner edge portions are positioned closely adjacent to the outer edge portions of the intermediate sections so that the cutting elements extending therefrom overlap to provide a continuous cutting pattern along the drum member front portion. In U.S. Pat. No. 3,773,384 clearance for the drive shaft that rotates the cutter drum is provided by cutting elements that overlap along the front of the drum.

There is need for a full face drum-type mining machine that has a continuous longitudinal cutting pattern along the length of the drum member without auxiliary cutting devices extending around fixed bearing supports of the boom member or without overlapping cutting elements of the drum member.

SUMMARY OF THE INVENTION

In accordance with the present invention there is provided a continuous mining machine for dislodging material from a mine face that includes an elongated body portion. Traction devices are provided for propelling the body portion. A boom member is pivotally connected to the body portion and extends forwardly therefrom. A drum member is rotatably mounted on the front of the boom member transversely to the body portion. The drum member has an intermediate section and a pair of end sections. The end sections extend outwardly from the intermediate section. The pair of end sections are spaced from the intermediate section, and a pair of openings are formed between the intermediate section and the respective end sections. Input drive devices for rotating the drum member extend through the pair of openings. The drum member intermediate and end sections have cutting elements extending therefrom for dislodging material from the mine face upon rotation of the respective sections. The cutting elements are positioned on opposite sides of the pair of openings. A pair of housing assemblies extend forwardly from the boom member and around the pair of openings. The housing assemblies surround the input drive devices. The housing assemblies each has an outwardly projecting portion that extends around a part of the opening and forwardly of the drum member. The outwardly projecting portions are operable to dislodge from the mine face the material positioned in front of the pair of openings and between the cutting elements of the respective drum member sections so that the drum member dislodges material along its entire length.

Each housing assembly includes a structural housing that extends forwardly from the boom member into the respective opening. An input shaft of the input drive devices extends through the structural housing and into the respective opening between the drum member intermediate section and the respective end section. A bevel pinion is connected to the end of each input shaft and meshes with a bevel gear that is rotatably positioned in each drum member end section. A planetary gear train is rotatably supported in each drum member end section and transmits rotation from the bevel gear to the respective drum member end section.

The drum member intermediate section is connected to the drum member end sections by output shafts. The output shafts are nonrotatably connected to the intermediate section and the end sections. Thus rotation is transmitted from the drum member end sections through the output shafts to the drum member intermediate section. The housing assemblies rotatably support the rotatable drum member sections and do not rotate therewith.

The outwardly projecting portions of the pair of housing assemblies extend around the front portion of the drum member. Each of the outwardly projecting portions has an annular body portion terminating in an outwardly projecting pointed portion. The outwardly projecting portions extend the width of the openings between the cutting elements on the adjacent drum sections. The forward edge of each outwardly projecting portion is aligned with the periphery of the drum member end sections so that the outwardly projecting portions are operable with the cutting elements to break and dislodge material from the mine face during sumping operations of the mining machine, as well as, during upward and downward shearing of the mine face by the drum member. With this arrangement, the pair of housing assemblies are operable to dislodge the unmined material at the location where the boom member rotatably supports the drum member. Thus material is dislodged from the mine face the full length of the drum member.

Accordingly, the principal object of the present invention is to provide a continuous mining machine having a cutter drum member rotatably supported by a pair of housing assemblies extending from a boom member in which the housing assemblies and the cutting elements on the drum member are operable to dislodge material from the mine face so that a single kerf is dislodged from the mine face along the entire length of the drum member.

Another object of the present invention is to provide a continuous mining machine having a drum member that includes an intermediate section axially spaced from a pair of end sections in which rotation is transmitted to the end sections and therefrom to the intermediate section with the spaces between the drum member intermediate section and the end sections enclosed by fixed housings that have portions operable to dislodge material from the mine face.

These and other objects of the present invention will be more completely disclosed and described in the following specification, the accompanying drawings and the appended claims.

DESCRIPTION OF THE PREFERRED EMBODIMENT

Figure 1:
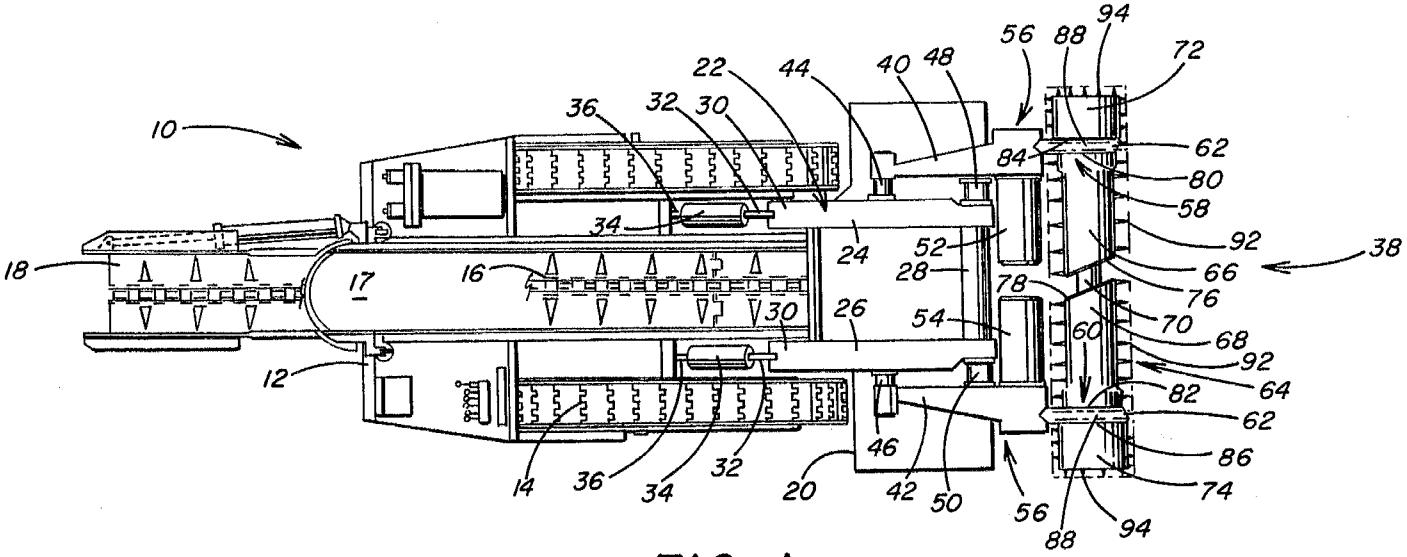
FIG. 1 is a top plan view of a continuous mining machine, illustrating a drum member having an intermediate section axially spaced from a pair of end sections with a pair of fixed housing assemblies extending between the cutting elements of the drum member sections and around the spaces therebetween.
Figure 2:
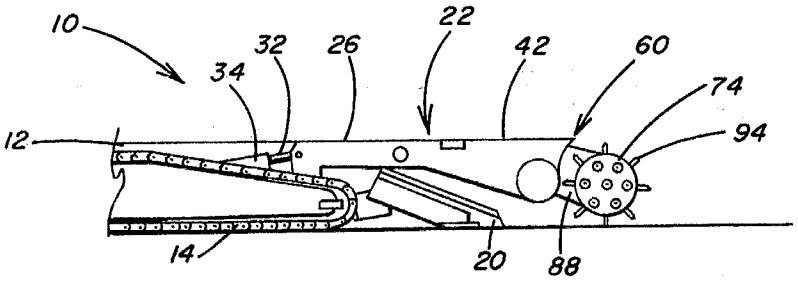
FIG. 2 is a fragmentary view in side elevation of the mining machine shown in FIG. 1, illustrating one of the housings that extends forwardly from a boom member and around the opening between the drum member intermediate section and an end section.

Referring to the drawings and particularly to FIGS. 1 and 2, there is illustrated a continuous mining machine generally designated by the numeral 10 that has a body portion 12 suitably mounted on traction devices, such as endless crawler tracks 14, for advancing the mining machine in a mine. An endless conveyor mechanism 16 is positioned in a longitudinal trough 17 and is arranged to convey dislodged material from the front of the mining machine to an articulated discharge end portion 18 of the conveyor 16. A suitable gathering device 20 extends forwardly from the body portion 12 and is arranged to gather the dislodged material and feed the dislodged material onto the conveyor 16 so that the material can be conveyed rearwardly to the discharge end portion 18.

A forwardly extending boom member generally designated by the numeral 22 has a pair of parallel arm members 24 and 26 that extend forwardly from the mining machine body portion 12 and are connected to each other adjacent their front end portions by a transverse housing 28. The arm members 24 and 26 are pivotally connected to the mining machine body portion 12 and are also pivotally connected at boom arm end portions 30 to piston rods 32 of piston cylinder assemblies 34. The piston cylinder assemblies 34 are, in turn, pivotally connected to the mining machine body portion 12 by pivot connections 36 so that the piston assemblies 34 are arranged to pivot the boom member 22 about the respective end portions of the arm members 24 and 26 to move the boom member 22 vertically for an upward or downward shear cut of the mine face by a drum member generally designated by the numeral 38.

The boom member 22 has a second pair of parallel arm members 40 and 42 that are supported at their rear end portions by stabilizer rods 44 and 46. The stabilizer rods 44 and 46 have a generally cylindrical configuration that extends through suitable cylindrical passageways in the respective arm members 40 and 42.

The transverse housing 28 is supported by the ends of the boom arm members 24 and 26 and has a cylinder therein with piston rods 48 and 50 extending outwardly therefrom. The piston rods 48 and 50 support the respective boom arm members 40 and 42 and are connected to pistons within a cylinder in transverse housing 28. Suitable means may be provided as described in greater detail in U.S. Pat. No. 3,774,969, which is incorporated herein by reference, to move the piston rods 48 and 50 outwardly to extend the intermediate section of the drum member 38 during the mining operation. The particular construction of the previously described boom member that permits extension and retraction of the drum member is not of essence so far as the present invention is concerned. When the intermediate section of the drum member 38 is unitary so that the drum member is not extensible and has a fixed longitudinal dimension, the rods 48 and 50 may be similar to the rods 44 and 46 to support the boom arms 40 and 42 from the transverse housing 28.

Drum rotating motors 52 and 54 are positioned between and secured to the arm members 40 and 42. The motors 52 and 54 are operable as later described to rotate the drum member 38 and are connected through clutch mechanisms generally designated by the numeral 56 to the drive gearing for the drum member 38. The drum member 38 is rotatably supported by a pair of fixed housing assemblies generally designated by numeral 58 and 60 which form a part of the arm members 40 and 42 and extend forwardly from the arm members 40 and 42. With this arrangement housing assemblies 58 and 60 constitute portions of the boom member 22.

Each of the housing assemblies 58 and 60 has an outer annular body portion 88 and a forwardly and outwardly extending portion 62 which extends substantially around the circular periphery of the drum member 38 and is operable as a dislodging device to break and dislodge material from a mine face during both sumping and vertical shearing operations so that a continuous cutting pattern is formed the entire length of the drum member 38. With this arrangement material is dislodged from the mine face along the entire length of the drum member 38.

Figure 3:
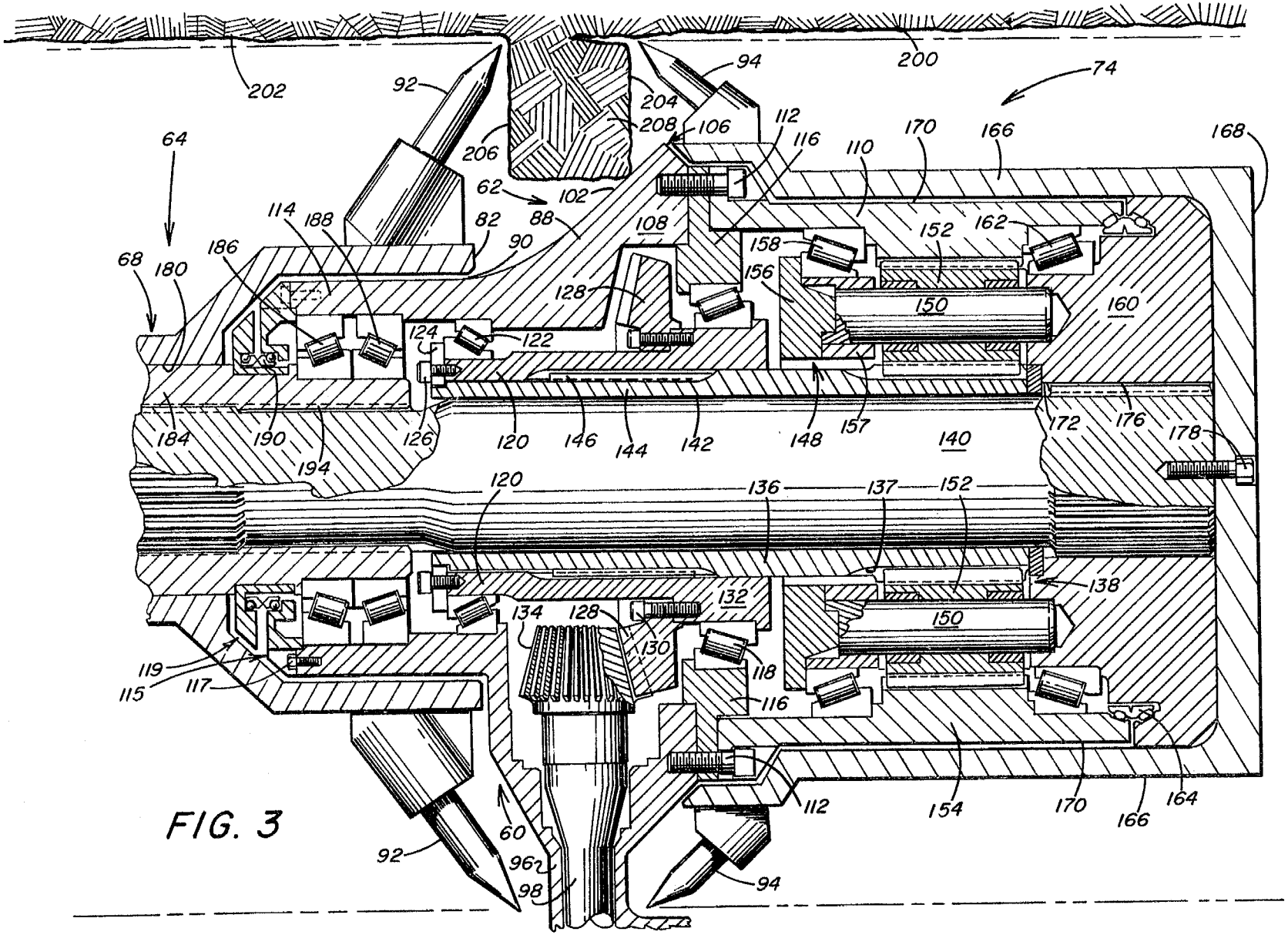
FIG. 3 is a fragmentary view in section of a portion of the drum member, illustrating one of the housing assemblies that extends around the opening in the drum member between the intermediate section and one of the end sections and between the cutting elements on the adjacent drum member sections.

The drum member 38 has an intermediate portion generally designated by numeral 64 comprising a pair of intermediate sections 66 and 68 that are connected to each other by a shaft 70. As illustrated in FIG. 3, the drum member 38 has a pair of end sections 72 and 74 that extend axially from the respective intermediate sections 66 and 68. It should be understood further in accordance with the present invention that the end sections 72 and 74 may extend at an angle from the respective intermediate sections 66 and 68. This angled or canted arrangement is disclosed in U.S. Pat. No. 3,848,930 which is incorporated herein by reference. With the canted arrangement herein the cutting elements of the adjacent drum sections do not overlap, as will be discussed later in detail. The end sections 72 and 74 are rotatably supported by the housing assemblies 58 and 60 for rotation with the intermediate sections 66 and 68. The drum member intermediate sections 66 and 68 and the end sections 72 and 74 are arranged to move toward and away from each other to extend and retract the drum member 38 in a manner known in the art as disclosed in U.S. Pat. No. 3,774,969.

The intermediate drum member sections 66 and 68 have a cylindrical configuration with inner annular end walls 76 and 78 and outer annular end walls 80 and 82. The end walls 80 and 82 extend parallel to the longitudinal axis of the mining machine 10. The boom member end sections 72 and 74 have a cylindrical configuration with inner annular end walls 84 and 86 that are spaced from and parallel to the outer annular end walls 80 and 82 of the drum member intermediate sections 66 and 68 respectively. With this arrangement, a pair of openings 90 are formed between the drum member intermediate portion 64 and the respective end sections 72 and 74. FIG. 3 illustrates the space between the end wall 82 of the intermediate section 68 and the adjacent end wall 86 of the end section 74 that forms the opening 90 therebetween.

As illustrated in FIG. 1, the drum member intermediate portion 64 has a plurality of cutting elements 92 that extend radially from the cylindrical surface of the drum member. As illustrated in FIGS. 1 and 2, the drum member end sections 72 and 74 also have a plurality of cutting elements 94 that extend radially from the cylindrical surfaces of the respective end sections and from the end of the respective sections. Because the drum member end sections 72 and 74 are spaced from drum member intermediate sections 66 and 68, the cutting elements 94 of the end sections 72 and 74 are spaced from the adjacent cutting elements 92 of the intermediate sections 66 and 68. The pair of housing assemblies 58 and 60 extend around the openings 90 between the cutting elements 92 and 94 of the intermediate sections 66 and 68 and the end sections 72 and 74 respectively.

The housing assembly outwardly projecting portions 62 extend outwardly from the surface of the drum member 38 and occupy the space between the adjacent rows of cutter elements on the end and intermediate sections of the drum, as illustrated in FIGS. 1 and 3. In FIG. 3 only the cutter elements 92 and 94 adjacent the outwardly projecting portion 62 are shown; however, the bit path formed by the cutter elements is illustrated schematically by the dashed line. The projecting portions 62 are operable with the cutting elements 92 and 94 to form a continuous dislodging pattern along the entire length of the drum member 38.

With this arrangement the forwardly projecting portions 62 are operable to dislodge the portion or core of the mine face formed by the adjacent rows of cutter elements on the end and intermediate sections and not dislodged by the cutter elements from the mine face. Thus the outwardly projecting portions 62 dislodge material along an area where the housing assemblies 58 and 60 on boom member 22 rotatably support the drum member 38. This arrangement permits the drum member end sections to be axially positioned relative to the drum member intermediate portion to dislodge a continuous kerf without auxiliary cutting devices extending around the bearing supports of the boom member or without overlapping cutting elements of the respective drum sections. Also this arrangement permits the drum end sections to be canted from the longitudinal axis of the drum member intermediate portion toward the mine face to dislodge a continuous kerf without overlapping the cutting elements of the respective drum sections.

Referring to FIG. 3, there is illustrated in section the drive arrangement for the drum member intermediate section 68 and one of the end sections 74 and the housing assembly 60. It should be understood that the drive gearing for the other drum member intermediate section 66 and the end section 72 is similar to that illustrated in FIG. 3, and the other housing assembly 58 is similar to the housing assembly 60 also shown in FIG. 3. Therefore, the description will be confined to the drive means for the drum member intermediate section 68 and the end section 74 and the housing assembly 60.

The housing assembly body portion 88 extends forwardly from the boom member 22 and includes a structural housing 96 through which an input drive shaft 98 extends from the motor 54 into the opening 90. The structural housing 96 forms the gear case for the drum member drive as will be explained later in greater detail. The outwardly projecting portion 62 of the body portion 88 has an arcuate configuration that extends outwardly from the annular body portion 88 substantially around the periphery of the drum member. The outer surface of the portion 62 has an inclined sidewall 102 that terminates in an outwardly extending portion 106. The inclined sidewall 102 with the portion 106 extends outwardly substantially around the circular periphery of the drum member so that the core material left in front of the drum member is fractured from the mine face and dislodged by the side thrust exerted upon the core by the sidewall 102 of the projecting portion 62 during sumping movement of the drum member 38 into the mine face. The portion 62 also extends substantially around the upper and lower periphery of the drum member 38 in an arrangement which is operable to break and dislodge material from the mine face by upward and downward shear cuts of the drum member 38.

With this arrangement as illustrated in FIG. 2, the housing assembly 60 has upper and lower portions which extend rearwardly from the annular body portion 88 and are spaced from the outer cylindrical surface of the respective drum member sections. The inclined sidewall 102 is operable to dislodge the unmined material at the location opposite the opening 90 between the cutting elements 92 and 94 of the respective drum member sections 68 and 74. This arrangement provides a continuous dislodging pattern the length of the drum member 38 to dislodge a full face.

The housing assembly 60 includes an in-turned flange portion 108 to which a cylindrical shaped support member 110 is secured by means of bolts 112. The housing assembly 60 also includes an end portion 114 that extends into underlying relation with the drum member intermediate section 68 and is connected to a seal retainer generally designated by the numeral 115 by bolts 117. A second seal retainer generally designated by the numeral 119 is suitably connected for rotation with the drum member intermediate section 68. A fixed bearing retainer 116 is also secured to the housing assembly flange portion 108 by bolts 112. The bearing retainer 116 supports bearings 118 that in turn rotatably support a tubular sleeve 120 that extends transversely in the space of opening 90. The tubular sleeve 120 is also rotatably supported by the housing assembly flange end portion 114 by bearings 122. The bearings 122 are secured in place relative to the tubular sleeve 120 and the housing assembly flange 114 by a bearing retainer 124 that is secured by bolts 126 to the end portion of the tubular sleeve 120.

A bevel gear 128 is secured by bolts 130 to an outer flange portion 132 of the tubular sleeve 120. The tubular sleeve 120 is splined to the external surface of a tubular shaft 136 to transmit rotation from bevel gear 128 through tubular sleeve 120 to tubular shaft 136. The input drive shaft 98 has a bevel pinion 134 secured thereto, and the bevel pinion 134 meshes with the bevel gear 128 secured to the end of the sleeve 120. With this arrangement, rotation of the shaft 98 is transmitted from the bevel pinion 134 to the bevel gear 128 to the tubular sleeve 120 and therefrom to the tubular shaft 136. The tubular shaft 136 has an external gear portion 137 adjacent one end that serves as a sun gear 137 for a planetary gear train generally designated by the numeral 138.

The sun gear 137 is rotatably mounted around an output drive shaft 140 that extends from the drum member end section 74 into the drum member intermediate section 68. The output drive shaft 140 extends through an axial bore 142 of the tubular shaft 136. The tubular shaft 136 has an outer tubular portion 144 which is splined to the tubular sleeve 120 by the splined connection 146. Thus with this arrangement, rotation of the bevel pinion 134 of the input shaft 98 is transmitted through the splined connection 146 to rotate the tubular shaft 136 and the sun gear portion 137 of the planetary gear train 138.

A planetary gear cage generally designated by the numeral 148 has a plurality of planet gear support shafts 150 mounted therein with planet gears 152 positioned thereon. The planet gears 152 mesh with the sun gear 137 and a ring gear portion 154 of the fixed cylindrical support member 110. With this arrangement rotation of the sun gear 137 revolves the planet gears 152 on the fixed ring gear portion 154. The planetary gear cage 148 rotates about the axis of the sun gear 137 which is concentric with the axis of the drum member end section 74.

Each of the planetary gear support shafts 150 are connected at one end portion to bearing retainers 156 and 157 and at the opposite end portion to a generally cylindrical end section internal support member or retainer 160. Retainers 156 and 157 surround the tubular shaft 136 and support bearings 158 for rotation relative to the fixed cylindrical support member 110. Thus members 156 and 157 serve as retainers for bearings 158 as well as for shafts 150. The support member 160 is rotatably supported relative to the support member 110 by bearings 162. Suitable lubricant seals 164 are provided between the annular end portion of support member 160 and the adjacent end of the support member 110.

The drum member end section 74 has a generally cup-shaped configuration with a cylindrical sidewall 166 and an end wall 168. The cylindrical sidewall 166 is rotatably positioned on a cylindrical wall 170 of support member 110. The end section internal support member 160 has an axial bore 172 therethrough. The roller bearings 158 and 162 are positioned between the fixed support member 110 that is secured to the body portion 88 of housing assembly 60 and the planetary gear cage 148 and the end section support member 160 to permit rotation of the drum member end section 74 relative to the fixed support member 110.

The shaft member 140 is nonrotatably secured by means of a splined connection 176 within the bore 172 of internal support member 160 so that rotation of the internal support member 160 rotates the shaft member 140. The shaft 140 is connected to the drum member end section end wall 168 by bolt 178 to maintain the end section 74 in position. Thus with this arrangement rotation of the bevel pinion 134 by input shaft 98 is transmitted through the planetary gear train 138 to the internal support member 160 which is connected to the drum member end section 74 so that the drum member 38 rotates. Rotation of the internal support member 160 is transmitted to the shaft member 140.

As stated hereinabove shaft member 140 extends from the drum member end section 74 into the drum member intermediate section 68. The drum member intermediate section has a generally cylindrical configuration with an axial passageway 180 therethrough. A tubular shaft 184 is axially positioned in the drum member intermediate section 68 in axial passageway 180 and is rotatably supported by pairs of roller bearings 186 and 188 within the flanged end portion 114 of the housing assembly 60. Suitable lubricant seals 190 are provided between the annular end portion of the housing assembly flange end portion 114 and the adjacent tubular shaft 184. The tubular shaft 184 is non-rotatably secured in the passageway 180 to the drum member intermediate section 68 by suitable means for rotation therewith. The tubular shaft 184 has an internally splined end portion 194 secured in receiving key portions of the shaft 140. With this arrangement rotation of the shaft 140 is transmitted through the tubular shaft 184 to the drum member intermediate section 68 and straight through drive is transmitted from the planetary 138 to the drum member intermediate section 68. It should be understood that the present invention is not limited to the above described planetary gear train 138 for transmitting drive from the drum end sections to the drum intermediate section but may include other drive arrangements, such as meshing bevel gears or a two stage planetary gear train, known in the art.

FIG. 3 illustrates diagrammatically the manner in which the material that is not dislodged by the cutter bits is fractured and dislodged by the inclined sidewall 102 of the housing assembly 58. The generally linear borders 200 and 202 with the vertical shoulders 204 and 206 define the area of the mine face cut by the drum end section 74 and drum intermediate section 68. The bit pattern is such that a column or core 208 of material remains between the adjacent cutter bits on the drum intermediate and end section. As the drum member advances into the material to be dislodged from the face, the cutter bits form the pattern illustrated in FIG. 3. The forwardly extending portions 62 of housing assembly 60 move into the column defined by the walls 204 and 206, and the inclined sidewall 102, by means of a wedging action, fractures and breaks away the core 208 to permit the drum member 38 to dislodge material along the entire length of the drum member. Preferably, as illustrated in FIG. 3, the end of the drum member intermediate section 68 adjacent the housing forwardly extending portion 62 has a reduced diameter in comparison with the diameter of the drum end section 74. This arrangement facilitates the movement of the dislodged core 208 away from the mine face into the area between the drum member intermediate section and the mine face.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A continuous mining machine for dislodging mine material from a mine face comprising, an elongated body portion, traction means for propelling said body portion, a boom member pivotally connected to said body portion and extending forwardly therefrom, a drum member rotatably mounted on the front of said boom member transversely to said body portion, said drum member having an intermediate section and a pair of end sections, said end sections extending outwardly from said intermediate section, said pair of end sections being spaced from said intermediate section to form a pair of openings between said intermediate section and said respective end sections, input drive means for rotating said drum member, said input drive means extending through said pair of openings, said drum member intermediate and end sections having cutting elements extending therefrom for dislodging material from the mine face upon rotation of said respective sections, said cutting elements being positioned on opposite sides of said pair of openings, a pair of housing assemblies extending forwardly from said boom member and around said pair of openings respectively, said housing assemblies surrounding said input drive means, said housing assemblies each having an outwardly projecting portion extending around a part of said respective opening and outwardly from said drum member, said outwardly projecting portion having an arcuate configuration extending outwardly from said respective housing assembly thereby forming an outer surface, said outer surface having an inclined sidewall extending upwardly from adjacent said drum member intermediate section and terminating in said outwardly projecting portion, and said inclined sidewalls being operable to exert a side thrust upon mine material positioned in front of said pair of openings to fracture and dislodge said mine material from the mine face.

2. A continuous mining machine as set forth in claim 1 which includes, support means for supporting said drum member intermediate and end sections for rotation relative to said pair of housing assemblies, and output drive means for drivingly connecting said input drive means to said drum member intermediate and end sections to rotate said drum member intermediate and end sections relative to said pair of housing assemblies.

3. A continuous mining machine as set forth in claim 2 which includes, said output drive means being rotatably supported relative to said pair of housing assemblies so that said pair of housing assemblies remain fixed as said drum member intermediate and end sections rotate during the material dislodging operations.

4. A continuous mining machine as set forth in claim 1 in which, said pair of housing assemblies each includes an annular body portion with an outwardly projecting portion extending substantially around the periphery of said drum member, said outwardly projecting portion being positioned between said cutting elements of said drum member intermediate and end sections respectively, and said annular body portions and said outwardly projecting portions of said pair of housing assemblies being operable to break and dislodge from the mine face the material positioned in front of said pair of openings to provide a continuous cutting pattern with said cutting elements along the entire length of said drum member.

5. A continuous mining machine as set forth in claim 1 which includes, said pair of housing assemblies outwardly projecting portions each extending substantially around the upper and lower periphery of said drum member to break and dislodge material from the mine face in front of said pair of openings respectively by upward and downward shear cuts of said drum member.

6. A continuous mining machine as set forth in claim 1 which includes, said drum member end sections each including a cylindrical support member, bearing means for rotatably supporting said respective drum member end section relative to said cylindrical support member, and means for nonrotatably connecting said cylindrical support member to said pair of housing assemblies respectively to rotatably support said drum member intermediate and end sections from said pair of housing assemblies.

7. A continuous mining machine as set forth in claim 1 which includes, gear means positioned in said drum member end sections for meshing with said input drive means, means for rotatably supporting said gear means on said pair of housing assemblies, output drive means nonrotatably connected to said drum member end sections for rotating said drum member end sections, and intermediate gear means drivingly connecting said gear means and said output drive means for transmitting rotation from said gear means to said output drive means to rotate said drum member end sections.

8. A continuous mining machine as set forth in claim 7 which includes, shaft means nonrotatably connected to said output drive means for transmitting rotation of said drum member end sections to said drum member intermediate section, said shaft means extending from each of said respective drum member end sections through said pair of openings into said drum member intermediate section, said drum member intermediate section being connected for rotation with said shaft means, and said pair of housing assemblies rotatably supporting said shaft means in said drum member intermediate section and being fixed relative thereto.

9. A continuous mining machine as set forth in claim 1 which includes, said end sections extending axially from said intermediate section, said axially extending end sections being spaced from said intermediate section to form said pair of openings between said intermediate section and said respective end section, and said outwardly projecting portions being positioned between said cutting elements of said drum member intermediate and end sections respectively to dislodge material from the mine face in front of said pair of openings and provide a continuous cutting pattern along the entire length of said drum member for the axial arrangement of said drum member sections.

10. A continuous mining machine as set forth in claim 1 which includes, said end sections extending angularly to said intermediate section, said cutting elements on said intermediate section being spaced from said cutting elements on said respective end section to form said pair of openings between said intermediate section and said respective end sections, and said outwardly projecting portions being positioned between said cutting elements to dislodge from the mine face the material positioned in front of said pair of openings and provide a continuous cutting pattern along the entire length of said drum member for the angular arrangement of said drum member sections.

11. A continuous mining machine for dislodging material from a mine face comprising, an elongated body portion, traction means for propelling said body portion, a boom member pivotally connected to said body portion and extending forwardly therefrom, a drum member rotatably mounted on the front of said boom member transversely to said body portion, said drum member having an intermediate section and a pair of end sections, said end sections extending outwardly from said intermediate section, said pair of end sections being spaced from said intermediate section to form a pair of openings between said intermediate section and said respective end sections, input drive means for rotating said drum member, said input drive means extending through said pair of openings, said drum member intermediate and end sections having cutting elements extending therefrom for dislodging material from the mine face upon rotation of said respective sections, said cutting elements being positioned on opposite sides of said pair of openings, dislodging means connected to and extending forwardly from said boom member and around said pair of openings for dislodging from the mine face material positioned in front of said pair of openings and between said cutting elements of said respective drum member sections so that said drum member dislodges material along its entire length, said drum member intermediate section having opposite end portions positioned adjacent to said dislodging means, said drum member end sections having an outer cylindrical surface of a preselected diameter, said drum member intermediate section having an outer cylindrical surface of a preselected diameter less than said diameter of said drum member end sections to facilitate the movement of the material dislodged by said dislodging means away from the mine face into the area between said drum member intermediate section and the mine face, first gear means rotatably positioned in said drum member end sections and secured to said input drive means for transmitting rotation from said input drive means, output drive means nonrotatably connected to said drum member end sections and said drum member intermediate section, and second gear means drivingly connecting said first gear means to said output drive means in said drum member end sections to rotate said drum member end sections and thereby transmit rotation from said drum member end sections to said drum member intermediate section.

* * * * *